US008051979B2

(12) United States Patent
Smith et al.

(10) Patent No.: US 8,051,979 B2
(45) Date of Patent: Nov. 8, 2011

(54) INNOVATIVE PACKAGING FOR CONSUMER PRODUCT

(75) Inventors: Barry S. Smith, Hopewell, VA (US); Xuan M. Pham, Glen Allen, VA (US); Cary Longest, Midlothian, VA (US); Carl G. Miller, Richmond, VA (US); James D. Evans, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 331 days.

(21) Appl. No.: 12/213,952

(22) Filed: Jun. 26, 2008

(65) Prior Publication Data

US 2009/0000968 A1 Jan. 1, 2009

Related U.S. Application Data

(60) Provisional application No. 60/929,451, filed on Jun. 28, 2007.

(51) Int. Cl.
*B65D 85/00* (2006.01)

(52) U.S. Cl. ..... 206/256; 206/267; 206/815

(58) Field of Classification Search ..... 206/467, 206/469, 470, 471, 463, 464, 242, 256, 264, 206/815
See application file for complete search history.

(56) References Cited

U.S. PATENT DOCUMENTS

| | | | | |
|---|---|---|---|---|
| D52,821 | S | | 12/1918 | Gallaher |
| 1,906,742 | A | | 5/1933 | Coulapides |
| 2,011,399 | A | | 8/1935 | Driscoll |
| 2,494,724 | A | | 1/1950 | Schmidt |
| D174,831 | S | | 5/1955 | Nowak |
| D186,900 | S | | 12/1959 | Griese, Jr. |
| 3,039,671 | A | | 6/1962 | Chiamardas |
| 3,202,269 | A | | 8/1965 | Lewis et al. |
| 3,241,738 | A | | 3/1966 | Freiman |
| 3,278,109 | A | | 10/1966 | Salway |
| D213,356 | S | | 2/1969 | Buff |
| 3,467,248 | A | * | 9/1969 | Makowicki ..... 206/465 |
| 3,483,964 | A | * | 12/1969 | Muehling et al. ..... 426/123 |
| 3,530,917 | A | | 9/1970 | Donovan |
| 3,563,449 | A | | 2/1971 | Forbes, Jr. et al. |
| 3,685,717 | A | | 8/1972 | Seiferth et al. |
| 3,901,386 | A | | 8/1975 | Hennessey |
| 3,987,891 | A | | 10/1976 | Horvath |
| 4,003,467 | A | | 1/1977 | Focket et al. |
| D261,110 | S | | 10/1981 | Yoshimoto |
| D266,224 | S | | 9/1982 | Bronander, Jr. |
| D273,426 | S | | 4/1984 | Zucker |
| D281,398 | S | | 11/1985 | Kesselring |
| 4,589,430 | A | | 5/1986 | Sussman |
| D285,744 | S | | 9/1986 | Vinot |
| D287,919 | S | | 1/1987 | Clements |

(Continued)

OTHER PUBLICATIONS

Copending Design U.S. Appl. No. 29/287,110, filed Jun. 28, 2007.

(Continued)

*Primary Examiner* — Jacob K Ackun
(74) *Attorney, Agent, or Firm* — Buchanan Ingersoll & Rooney PC

(57) ABSTRACT

A package for containing an oral sensorial product includes a packet having a shaped front sheet having a raised inner portion and a resealable back sheet. The raised inner portion has at least one recess adapted to receive a product. The resealable back sheet peels away from the shaped front sheet without damaging either the shaped front sheet or the back sheet.

24 Claims, 7 Drawing Sheets

U.S. PATENT DOCUMENTS

| | | | | | |
|---|---|---|---|---|---|
| 4,696,402 | A | | 9/1987 | Harmon et al. | |
| 4,741,441 | A | | 5/1988 | Keffeler | |
| D304,303 | S | | 10/1989 | Hurst et al. | |
| 4,889,731 | A | * | 12/1989 | Williams, Jr. | 426/106 |
| D305,832 | S | | 2/1990 | Pence | |
| 4,925,316 | A | | 5/1990 | Van Erden et al. | |
| D309,570 | S | | 7/1990 | Kinoshita | |
| D318,013 | S | | 7/1991 | Elliot | |
| D319,587 | S | | 9/1991 | Lee | |
| 5,092,354 | A | | 3/1992 | Pacelli, Jr. | |
| 5,129,517 | A | * | 7/1992 | Hustad | 206/467 |
| 5,167,974 | A | | 12/1992 | Grindrod et al. | |
| D342,023 | S | | 12/1993 | Bonkowski | |
| 5,277,920 | A | * | 1/1994 | Weaver, Jr. | 426/115 |
| D344,018 | S | | 2/1994 | Kelsey et al. | |
| 5,353,935 | A | * | 10/1994 | Yeager et al. | 206/470 |
| 5,366,077 | A | | 11/1994 | Pham | |
| D353,091 | S | | 12/1994 | Mumford | |
| 5,373,862 | A | | 12/1994 | Blachut | |
| 5,503,858 | A | | 4/1996 | Reskow | |
| D370,301 | S | | 5/1996 | Murphy | |
| 5,605,167 | A | | 2/1997 | Montoli | |
| 5,704,480 | A | | 1/1998 | Scholz et al. | |
| D395,235 | S | | 6/1998 | Andersson | |
| D401,853 | S | | 12/1998 | Stavridis | |
| D423,931 | S | | 5/2000 | Davis | |
| 6,059,112 | A | * | 5/2000 | Dykstra et al. | 206/438 |
| 6,076,679 | A | | 6/2000 | Yuhara et al. | |
| D447,688 | S | | 9/2001 | Jalet et al. | |
| D459,222 | S | | 6/2002 | Mello et al. | |
| 6,467,614 | B1 | | 10/2002 | Tallier et al. | |
| D465,416 | S | | 11/2002 | Dzwill et al. | |
| D467,493 | S | | 12/2002 | Hussaini et al. | |
| 6,499,595 | B1 | * | 12/2002 | Petricca | 206/356 |
| D470,411 | S | | 2/2003 | Menceles | |
| D474,886 | S | | 5/2003 | Fleming et al. | |
| 6,627,814 | B1 | | 9/2003 | Stark | |
| D496,135 | S | | 9/2004 | Hillock | |
| 6,828,674 | B2 | | 12/2004 | Karpman | |
| 6,837,369 | B2 | | 1/2005 | Amos | |
| 6,932,219 | B2 | | 8/2005 | Chacko et al. | |
| D527,997 | S | | 9/2006 | Kudo et al. | |
| 7,109,580 | B2 | | 9/2006 | Heschel et al. | |
| D534,422 | S | | 1/2007 | Hallberg | |
| D537,561 | S | | 2/2007 | Counts et al. | |
| D549,094 | S | | 8/2007 | Oner et al. | |
| 7,281,630 | B2 | * | 10/2007 | Hartman et al. | 206/467 |
| 7,331,451 | B2 | | 2/2008 | Focke et al. | |
| D575,452 | S | | 8/2008 | Jones et al. | |
| D580,751 | S | | 11/2008 | Blick | |
| D584,141 | S | | 1/2009 | Smith | |
| 7,475,780 | B2 | * | 1/2009 | Hinze et al. | 206/469 |
| 7,578,391 | B2 | * | 8/2009 | Nakamura | 206/572 |
| 2003/0085146 | A1 | * | 5/2003 | Logan et al. | 206/469 |
| 2006/0042986 | A1 | * | 3/2006 | Simkowski | 206/470 |
| 2006/0283721 | A1 | | 12/2006 | Kutsch et al. | |
| 2007/0012711 | A1 | | 1/2007 | Kutsch et al. | |
| 2007/0157567 | A1 | * | 7/2007 | Curry | 53/443 |
| 2008/0093233 | A1 | | 4/2008 | Jones et al. | |

OTHER PUBLICATIONS

Copending Design U.S. Appl. No. 29/311,131, filed Dec. 29, 2008.

* cited by examiner

INNOVATIVE PACKAGING FOR CONSUMER PRODUCT

CROSS REFERENCE TO RELATED APPLICATION

This application claims priority under 35 U.S.C. §119(e) to U.S. provisional Application No. 60/929,451, filed on Jun. 28, 2007, the entire content of which is incorporated herein by reference.

SUMMARY

A hermetically sealed package having at least one recess or cavity, which is suited to contain consumer products, such as oral sensorial products or tobacco products.

BRIEF DESCRIPTION OF THE DRAWING FIGURES

DETAILED DESCRIPTION

Shown in the accompanying drawings is a hermetically sealed package, which includes at least one recess or cavity, which is suited to contain consumers products, such as oral sensorial products or tobacco products. Each individual package may contain the full quantity of new oral sensorial products or tobacco product for a retail package, or may contain a lesser number than a standard retail package for promotional projects. The lesser number of products allow consumers to try the new product, or variations of the new flavors, without the expense of a standard retail package. It can be appreciated that in accordance with one embodiment, the quantity of oral sensorial products or tobacco product in each package may be as low as one.

The package in accordance with one embodiment consists of a hermetically sealed package, with descriptive information, which is pre-printed on the package, embossed on the package, and/or provided on an applied label, coupon or which can be affixed to the package in the form of an onsert. For example, the onsert can be a sample of a product, a magnet, a small booklet or a targeted advertisement. Alternatively, the package may be standalone or may be contained in a box, folder or single sleeve with locking design.

In accordance with a preferred embodiment, the package consists of two flat pieces or sheets of film, foil, or similar material, sealed at the edges only, or sealed across the interior or inner portion of the package so as to individually seal the oral sensorial products or tobacco product within the package.

Alternatively, the package may also consist of a formed, recessed shaped front sheet with a formed or flat back sheet sealed to the edges of the shaped front sheet. The shaped front sheet may include a single recess to contain one or more uniquely designed oral sensorial products or tobacco product, or may include multiple recesses with each recess containing one or more uniquely designed oral sensorial products or tobacco. If the shaped front sheet contains multiple recesses, the flat back sheet may be sealed along the edges only, or may also be sealed along the dividing areas between the recesses so that each recess is sealed individually.

In accordance with another embodiment, the package may include tear notches, unsealed tabs for peel off at a corner of the package, or a resealable pull tab applied over precut windows for opening and resealing of the package, or other means to assist the consumer in opening the package.

Figure 1A:
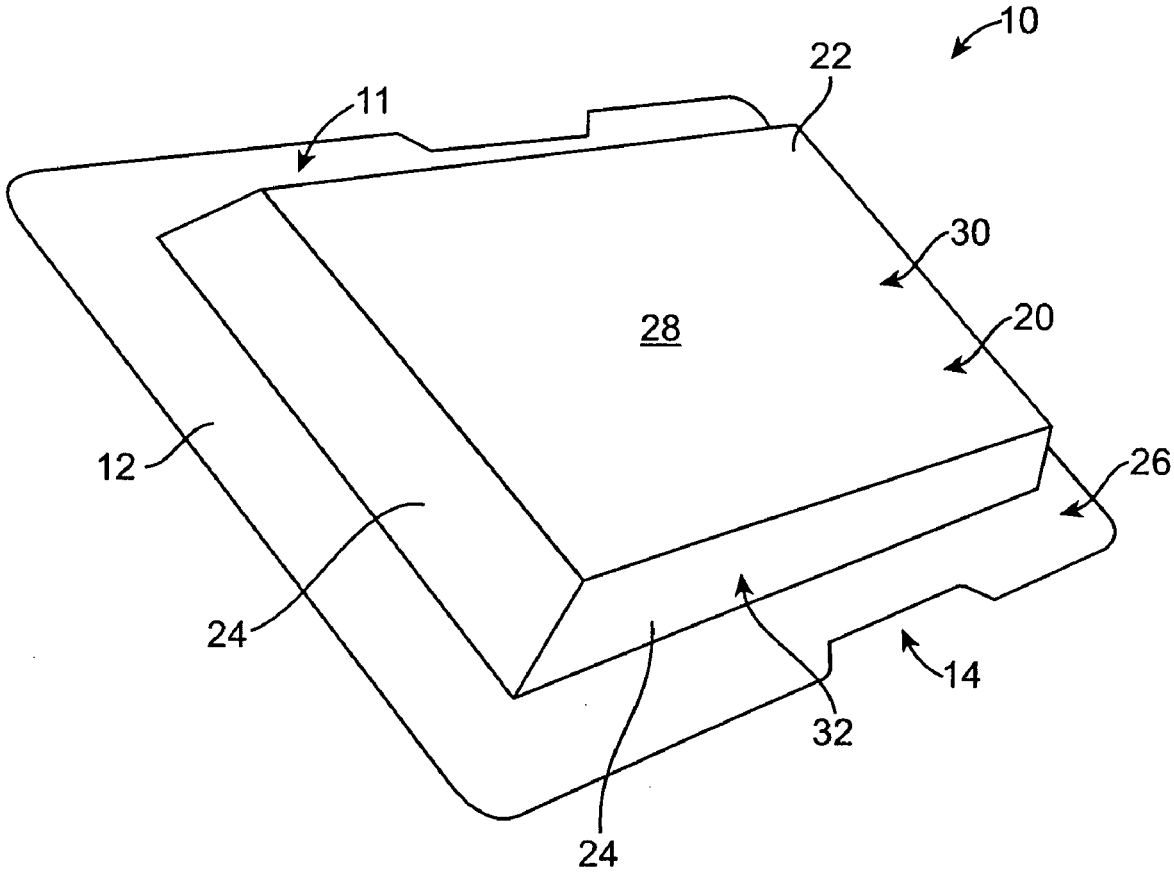
FIG. 1A is a perspective view of one side of a package in accordance with one embodiment.
Figure 1B:
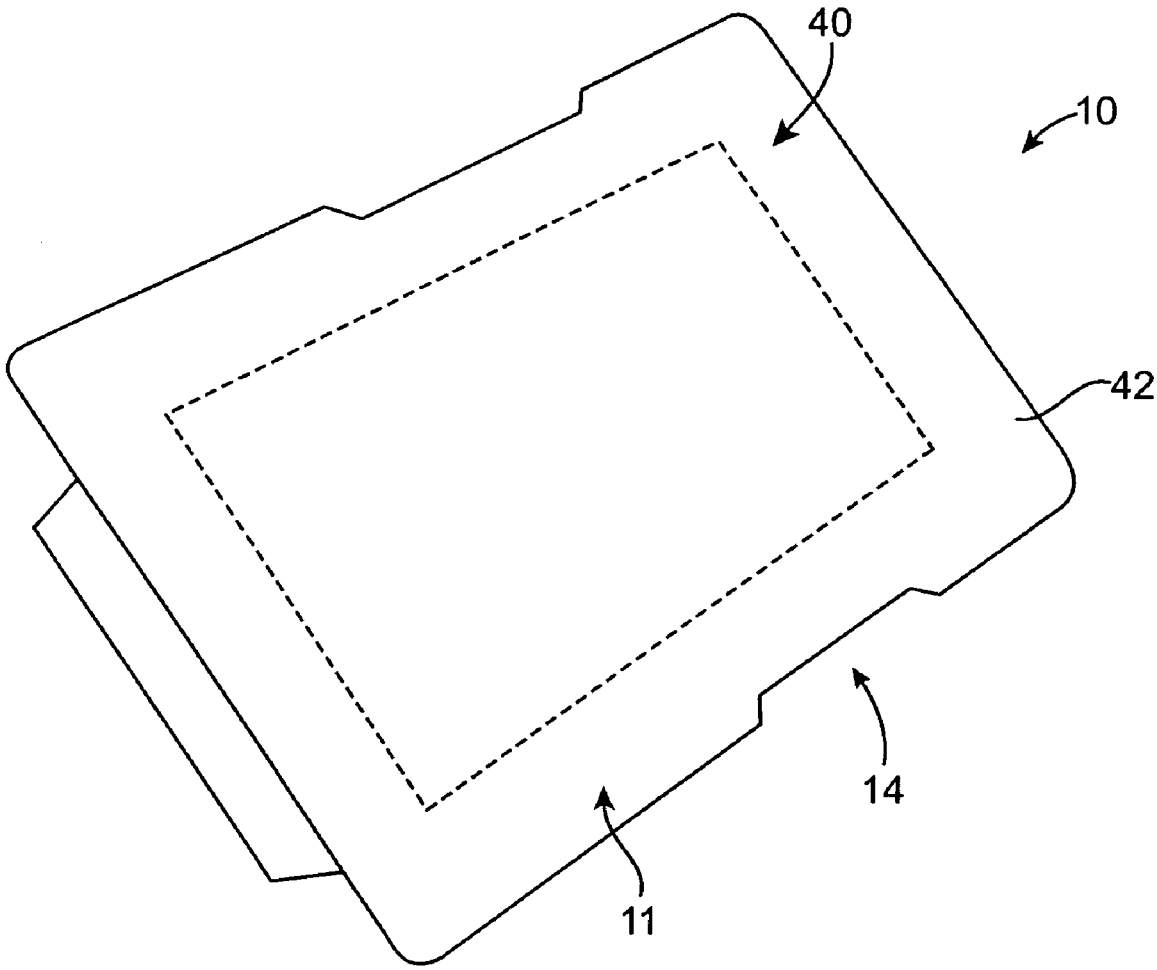
FIG. 1B is a perspective view of the opposite side of the package shown in FIG. 1A.

FIGS. 1A and 1B are perspective views of a package 10 for oral sensorial products in accordance with one embodiment comprised of a packet 11, which comprises a shaped front sheet 20 and a back sheet 40. As shown in FIG. 1A, an inner portion of the front sheet 20 is raised to create a raised inner portion 30. The raised inner portion 30 has a bottom wall 22 and a plurality of sidewalls 24. The back sheet 40 is preferably a film, foil, membrane or other suitable material, which hermetically seals the product within the inner raised portion 30 of the shaped front sheet 20 of the package 10. The back sheet 40 is preferably flat, however, it can be appreciated that the back sheet 40 can be a formed back sheet 40, which can include embossments, raised portions or other suitable imprints. In accordance with a preferred embodiment, back sheet 40 is a resealable back sheet, which peels away from the shaped front sheet 20 without damaging either the shaped front sheet 20 or the back sheet 40.

The shaped front sheet 20 also preferably includes a rim portion or border 26, which surrounds the at least one raised inner portion 30. Preferably, the border 26 is sealed with an outer portion 42 of the back sheet 40 with a suitable adhesive or other material, which allows the back sheet 40 to be easily separated from the shaped front sheet 20.

In accordance with a preferred embodiment, the back sheet 40 can be separated from the shaped front sheet 20 without damaging either the shaped front sheet 20 and/or the back sheet 40. In one embodiment, the border 26 surrounds an outer edge (not shown) of the raised inner portion 30 and has a width of between about 0.25 to 2.0 centimeters (cm), and more preferably about 0.50 cm to about 1.0 centimeters (cm). In accordance with an embodiment, the outer peripheral portion 42 of the back sheet 40 and the border 26 of the shaped front sheet 20 can include a pattern or other suitable imprint 12 from the sealing process.

In accordance with one embodiment, the bottom wall 22 of the shaped front sheet 20 has an outer surface (or front face) 28, which can include product indicia 29 (FIG. 2A), designs or the like which can be embossed on the outer surface 28. Alternatively, a label having product indicia 29, designs or the like can be applied to the outer surface 28.

In accordance with one embodiment, the shaped front sheet 20 includes at least one recess or cavity 32, which is adapted to hold the oral sensorial products inside the laminated or hermetically sealed packet 11 of a package 10. Alternatively, the shaped front sheet 20 can include a plurality of recesses and/or cavities 32, which are adapted to orient or position the product within the shaped front sheet 20. The recesses and/or cavities 32 also provide a means to prevent the package 10 from being overfilled, which can occur if the package 10 does not include separate recesses or cavities 32 and the package 10 is randomly filled.

It can be appreciated that the shaped front sheet 20 may be any shape including rectangular, square, oval, round, octagonal, and other shapes. In accordance with one embodiment, the raised inner portion 30 of the front sheet 20 has a rectangular recess or cavity 32 of about 3 to 10 cm by about 1 to 5 cm by about 0.25 to 2 cm; and more preferably about 6 cm by about 3 cm by about 0.5 cm.

In accordance with one embodiment, the package 10 can include a pair of recesses or cut-outs 14 at opposing locations in the rim portion 26 along the sides of the package 10. The recesses 14 assist the consumer with grasping the package 10. The cut-outs 14 also provide a guide for the placement of the consumer's fingers, while separating the back sheet 40 from the shaped front sheet 20. The cut-outs 14 preferably are about 2 to 3 cm in length and about 0.2 to 0.5 cm in depth. The cut-outs 14 are also preferably just slightly off the centerline of the package 10, which assists with the balancing of the package 10 during the removal of the product and separation of the shaped front sheet 20 from the back sheet 40.

Figure 2A:
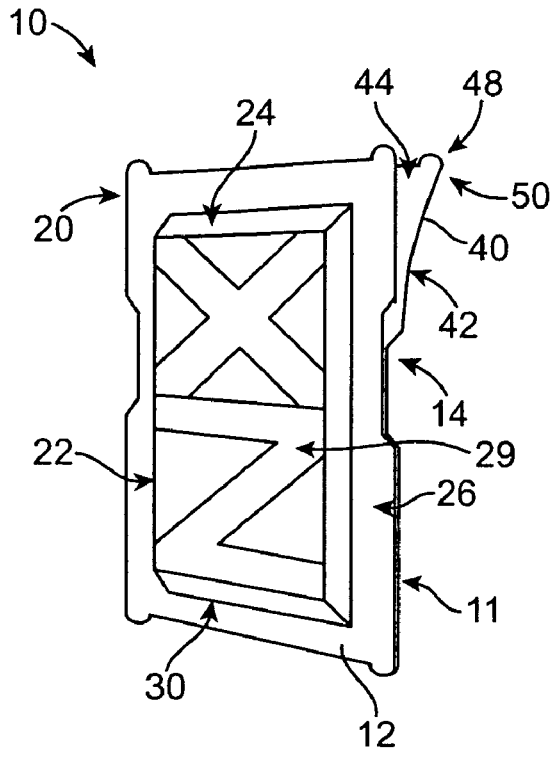
FIG. 2A is a perspective view of a package in accordance with another embodiment.
Figure 2B:
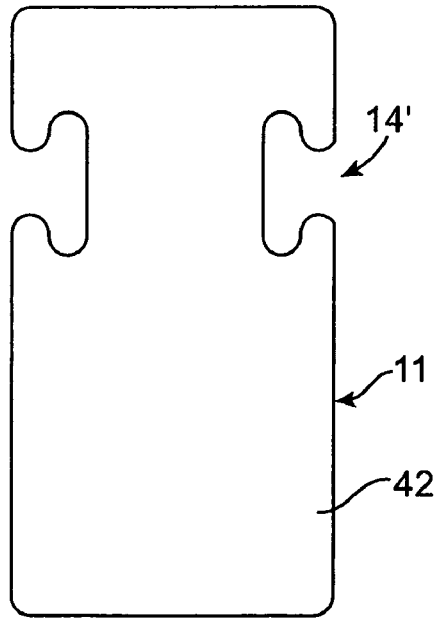
FIG. 2B is a planar view of a package with an alternative cut-out.

Alternate cut-outs 14' are shown in FIG. 2B. It can be appreciated that the cut-outs 14 can be any suitable design or shape, which assists the consumer with the handling of the package 10 or the cut-outs can be omitted or replaced with projections if desired.

In a preferred embodiment, the back sheet 40 covers the border 26 of the shaped front sheet 20. In another embodiment, the back sheet 40 may encapsulate the entire outer surface of the shaped front sheet 20. Also preferably, the shaped front sheet 20 is contoured to hold a plurality of oral sensorial products, such as smokeless tobacco products or snus (i.e., individual packets of tobacco material). In accordance with another embodiment, the package 10 can be designed to hold a limited number (i.e., 2 to 8) of cigarettes. It can be appreciated that the package 10 can also be used with non-tobacco products.

In accordance with one embodiment, the package 10 is comprised of a formed, recessed shaped front sheet 20 with a formed or flat back sheet 40 sealed to a rim portion or border 26 of the shaped front sheet 20. The shaped front sheet 20 may include a single raised inner portion 30 to contain one or more unique designed oral sensorial products or tobacco product, or may include multiple recesses or cavities 32 with each recess or cavity containing one or more unique designed oral sensorial products or tobacco. If the shaped front sheet 20 contains multiple recesses or cavities 32, the back sheet 40 may be sealed along the rim portion 26 only, or may also be sealed along the dividing areas (not shown) between the recesses or cavities 32 so that each recess or cavity 32 is sealed individually.

A hermetic or airtight seal is preferably formed between the border or edge 26 of the shaped front sheet 20 and the back sheet 40. The hermetic or airtight seal maintains the freshness of the enclosed product contained within the package 10. The back sheet 40 may be sealed to and/or around the shaped front sheet 20 using a suitable adhesive, heat seal, and/or weld. In accordance with another embodiment, the hermetically sealed recess or cavity 32 can be conveniently opened, and optionally resealed. The hermetic or airtight sealing of the package 10 also prevents water and/or other elements from entering the recess or cavity 32 of the package 10.

The shaped front sheet 20 and the back sheet 40 are preferably formed from a film or foil membrane. The film or foil membrane is preferably a suitable plastics material, such as polypropylene. In a preferred embodiment, polypropylene is the preferred material since, polypropylene typically does not absorb the flavors associated with the product while the product is being stored. However, it can be appreciated that other suitable plastic materials such as polyethylene, polystyrene, nylon, polysulfone, polyester, polyurethane, and combinations thereof can be used. In other embodiments, the package 10 can be a metal or metal alloy. Suitable metals include without limitation aluminum.

In a preferred embodiment, the package 10 inhibits or prevents transition of the product to the shaped front sheet 20 and back sheet 40, and providing the product 80 (FIG. 4) with a shelf life of at least 6 (six) months and more preferably a shelf life of at least one year.

In accordance with a preferred embodiment, the package 10 including the shaped front sheet 20 is preferably formed by a cold forming mold process. However, it can be appreciated that the package 10 including the shaped front sheet 20 can be formed by any suitable molding methods including injection and/or thermal molding processes.

In a preferred embodiment, as shown in FIG. 2A, the back sheet 40 is preferably an easy peel type material or foil laminate, wherein an inner surface 44 of the back sheet 40 is attached to the rim portion 26 of the shaped front sheet 20 using an adhesive, a sealing lacquer and/or vinyl type material. In accordance with a preferred embodiment, the back sheet 40 forms a peelable bond that can be removed easily by hand. The inner surface 44 of the back sheet 40 preferably can be removed or separated from the rim portion 26 of the shaped front sheet 20 by peeling back the back sheet 40 from the rim portion 26 of the shaped front sheet 20.

In a preferred embodiment, the back sheet 40 can be removed and/or peeled away from the shaped front sheet 20 and/or rim portion 26 of the shaped front sheet 20 without damaging or destroying either the shaped front sheet 20 or back sheet 40. In accordance with another embodiment, the package 10 may include tear notches 48, (i.e., unsealed tabs) at a corner 50 of the package 10 to assist with the separation of the back sheet 40 from the shaped front sheet 20.

Figure 3:
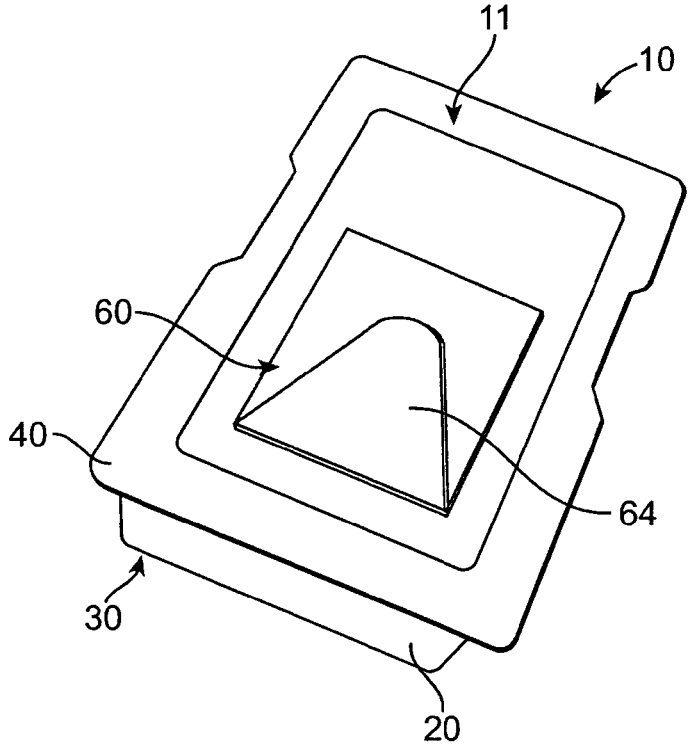
FIG. 3 is a perspective view of a package with a resealable pull tab in a closed position.

In accordance with another embodiment, the package 10 can include a resealable pull tab 60 on the back sheet 40 of the package 10. As shown in FIG. 3, the back sheet 40 includes a resealable pull tab 60 that is pulled by the consumer to break the seal and expose the product held within the at least one recess or cavity 32 of the raised inner portion 30. In an embodiment, as shown in FIG. 3, the back sheet 40 opens to reveal a recess or recessed cavity 32 defined by the bottom 22 and the sidewalls 24 of the shaped front sheet 20. The resealable pull tab 60 includes an openable window 62 (FIG. 4) having a pull tab 64 for providing access to the raised inner portion 30 (i.e., the at least one recess or cavity 32) within the shaped front sheet 20.

In accordance with a preferred embodiment, the openable window 62 is resealable. Alternatively, in accordance with another embodiment, only a portion of the back sheet 40 is opened and removed when the pull tab 60 is pulled. If desired, a section of material can be torn from the back sheet 40 when the pull tab 60 is pulled to form an accessible opening into the cavity 32 within the shaped front sheet 20 for removal of product. In a preferred embodiment, the back sheet 40 is pre-scored such that when the pull tab 60 is pulled a uniform section of the back sheet 40 is removed.

Figure 4:
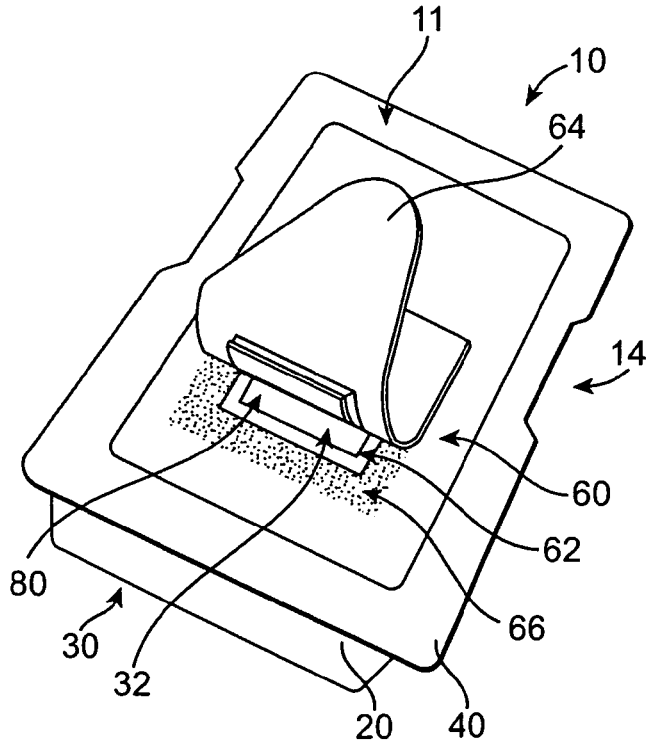
FIG. 4 is a perspective view of the package with a resealable pull tab in an open position.

FIG. 4 is a perspective view of the package 10 for consumer product such as oral sensorial products with a resealable pull tab 60 in an open position. The resealable pull tab 60 is pulled to open the back sheet 40 to provide access to the oral sensorial products 80 within the raised inner portion 30 of the shaped front sheet 20. The resealable pull tab 60 can include a pre-scored back sheet 40 with a permanent adhesive 66. In accordance with another embodiment, the pull tab 60 can be a single or one-time pull tab, wherein the pull tab 60 is not resealable.

Figure 5:
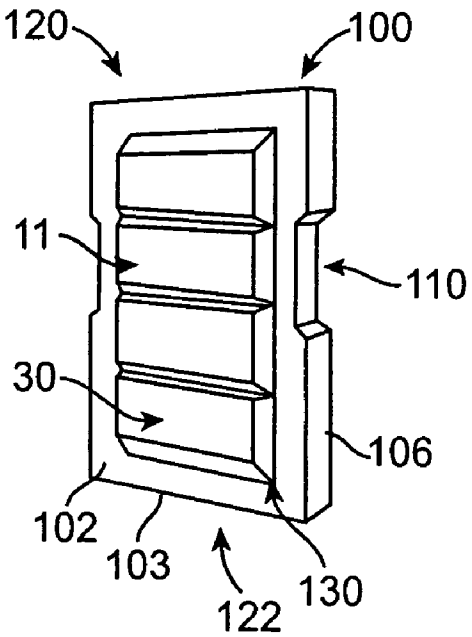
FIG. 5 is a perspective view of a sleeve having a package with a plurality of recesses.

FIG. 5 is a perspective view of a package 10 comprising a packet 11 of shaped front sheet 20 with a plurality of recesses or cavities 32, which is disposed within a protective sleeve 100. The protective sleeve 100 has a cutout window 130, which receives the raised inner portion 30. As shown, the package 10 consists of a formed, shaped front sheet 20 having a raised inner portion 30 with a plurality of recesses or cavities 32 with a formed or flat back sheet 40 sealed to the rim 26 of the shaped front sheet 20. The shaped front sheet 20 may include a single raised inner portion 30, which contains one or more oral sensorial products or tobacco product. Alternatively, as shown in FIG. 5, the shaped front sheet 20 can include a plurality of recesses or cavities 32 with each recess or cavity 32 containing one or more oral sensorial products or tobacco. If the shaped front sheet 20 contains multiple recesses or cavities 32, the back sheet 40 may be sealed along the edges only, or may also be sealed along the dividing areas between the recesses or cavities 32 so that each recess or cavity 32 is sealed individually. It can be appreciated that in accordance with another embodiment, an additional layer or sheet (not shown) can be inserted into the raised inner portion 30 to inhibit the transition of product and/or product flavors from one recess or cavity 32 to another recess or cavity 32. Alternatively, the additional layer or sheet can form a plurality of recesses or cavities 32 within the raised inner portion 30.

As shown in FIG. 5, the packet 11 preferably fits within the sleeve 100. The sleeve 100 preferably has a pair of open ends 120, 122 and includes a front panel 102, a back panel (not shown) and two side panels 106. It can be appreciated that in an alternative embodiment, a bottom panel 103 can be added to the sleeve 100, such that the packet 11 can be inserted into the sleeve 100 in only one direction. In accordance with another embodiment, at least one of the side panels 106 includes a slot or opening 110, which assists the consumer in removing the packet 11 from the sleeve 100. The sleeve 100 is preferably comprised of a paper or plastic material. However, it can be appreciated that any suitable biodegradable material or other suitable material can be used in the construction of the sleeve 100. The sleeve 100 can also include product identifiers including the source of the product, type of products within each of the plurality of recesses or cavities 32 of the packet 11, and other related information product information.

Figure 6:
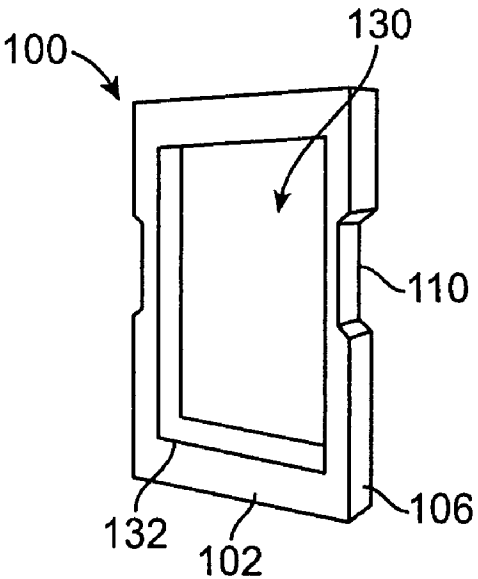
FIG. 6 is a perspective view of a package in a sleeve with a cut out window.

FIG. 6 is a perspective view of a protective sleeve 100 having a cut out window 130. As shown in FIG. 6, the sleeve 100 includes a front panel 102 having a cut out 132, which forms the cut out window 130. The cut out 132 is preferably in the same shape as the raised inner portion 30 of the shaped front sheet 20. For example, as shown in FIG. 5, if the raised inner portion 30 has a rectangular configuration, the cut out 132 is preferably a rectangular cut out 132.

Figure 7A:
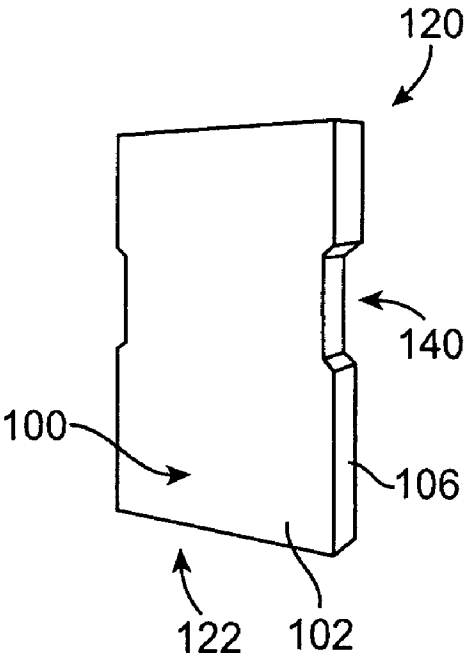
FIG. 7A is a perspective view of a protective sleeve having a locking design.

FIG. 7A is a perspective view of a package 10 comprising a packet 11 and a sleeve 100 with an optional locking design. The sleeve 100 includes a front panel 102, a back panel (not shown), and a pair of side panels 106. The packet 11 fits within the sleeve 100 and includes a locking mechanism 140 to retain the packet 11 within the sleeve 100. In accordance with one embodiment, the locking mechanism 140 can be a pair of resilient catches, which engage the cut-outs 14 of the packet 11. The pair of resilient portions are located along opposite sides of the sleeve 100, wherein the resilient portions extend into the cut-outs 14 of the packet 11 so as to releasably hold the packet 11 in the sleeve 100. The resilient portions disengage the cut-outs 14 upon application of finger pressure on an end of the packet 11 to allow withdrawal of the packet 11 from one of the open ends 120, 122 of the sleeve 100.

Figure 7B:
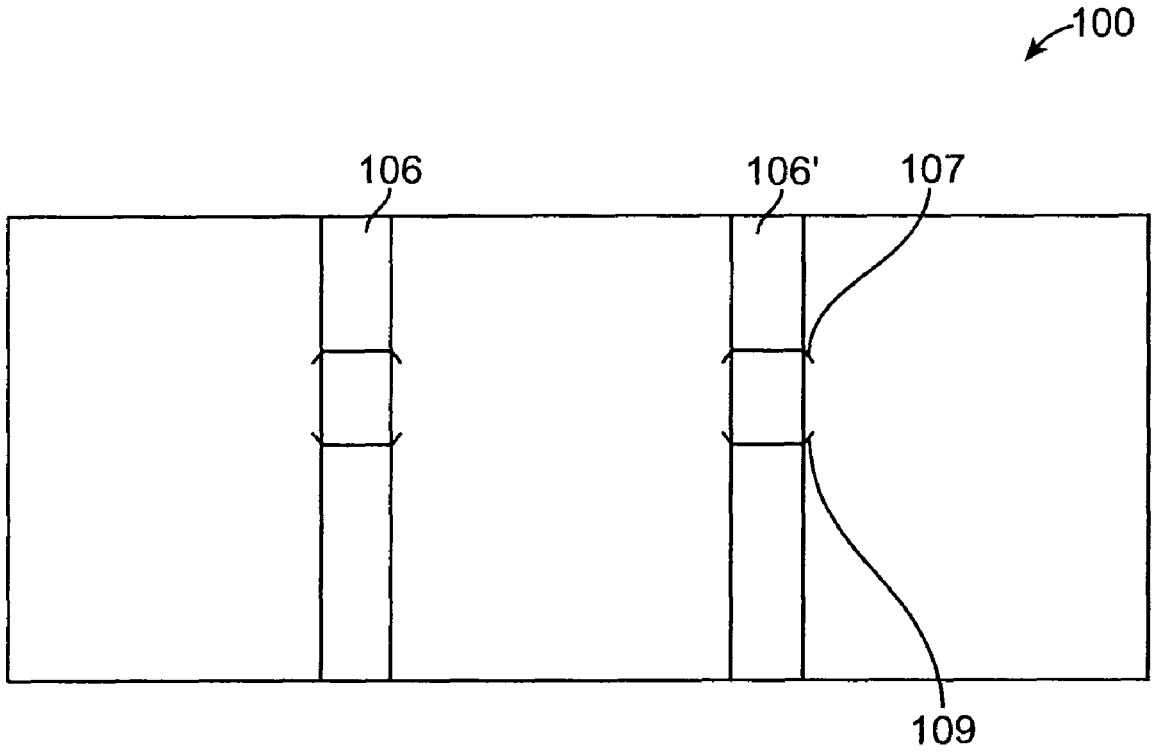
FIG. 7B is a planar view of an unfolded blank of the sleeve in FIG. 7A showing its cut lines.

Referring now to FIG. 7B, the blank used to form the sleeve 100 of FIG. 7A bears cut lines 107, 109 in the form of opposing angulated "c's" at side panels 106, 106', such that when folded, the cut lines 107, 109 create side panel portions which, when pressed inwardly, releasably engage the recesses 14 of the packets 11.

Figure 8:
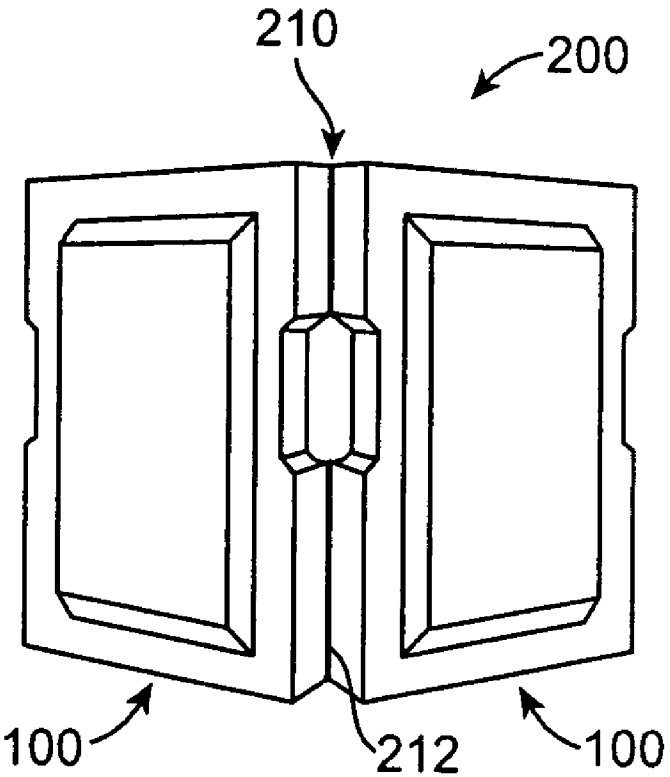
FIG. 8 is a perspective view of a package comprised of a pair of connected sleeves, each sleeve holding a packet.

FIG. 8 is a perspective view of a double connection sleeve design 200 for a pair of packets 11. As shown in FIG. 8, the double connection sleeve design 200 is comprised of a pair of sleeves 100, which are attached to one another via a hinge 210. The hinge 210 is formed at an outer edge 212 on each of the sleeves 100, such that the pair of sleeves 100 can be opened to disclose or reveal the source of the products, descriptive material related to the products within the packages and other marketing or trademark information. In an alternative embodiment, the packets 11 can include an added hinge cover sheet (not shown), which protects the back sheet 40. In accordance with an embodiment, the pair of packets 11 are connected by a hinge cover sheet, which is added to the back sheets 40 of each of the packets 11.

Figure 9:
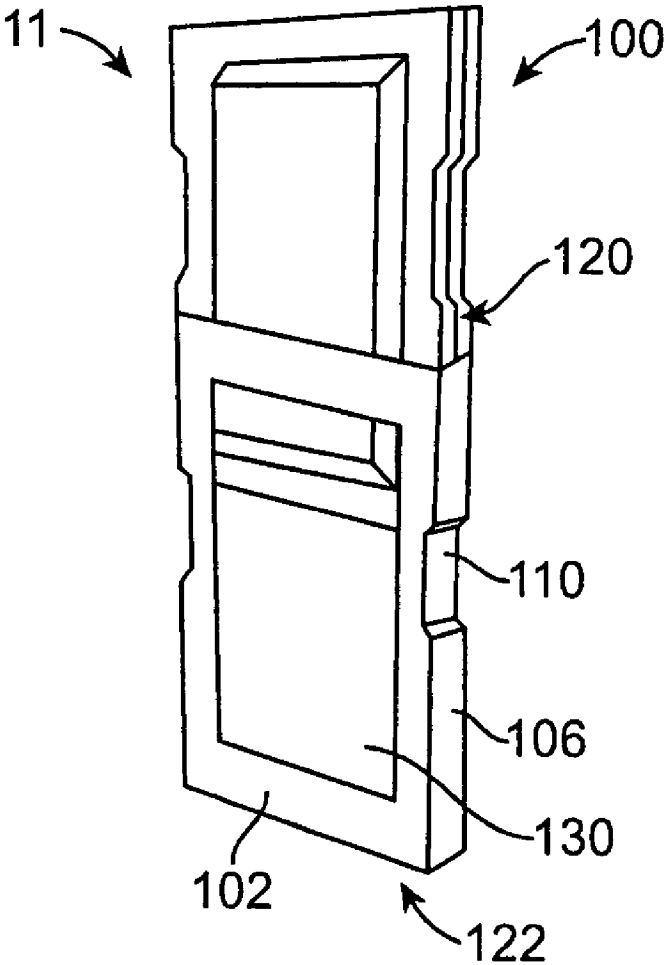
FIG. 9 is a perspective view of a protective sleeve, which is adapted to hold a plurality of packets.

FIG. 9 is a perspective view of a single sleeve 100, which is configured to hold a plurality of packets 11. As shown in FIG. 9, the sleeve 100 includes a front panel 102, a back panel (not shown), and a pair of side panels 106. The width of the pair of side panels 106 are preferably a multiple of the number of packets 11 that the sleeve 100 is designed to hold. The sleeve 100 is preferably designed to hold at least one packet 11, and more preferably designed to hold at least three or more packets 11.

Alternatively, a plurality of packets 11 with or without cut-outs 14 can be placed in a hinge-lid box having a lower box portion and an upper lid portion that is hinged to a front, a side or a back wall of the box portion. The lid pivots upward to open the box and reveal the packets 11 contained therein. In such box, the cut-outs 14 preferably do not engage a locking mechanism in the box. For example, a box with a hinged-lid is disclosed in commonly-owned U.S. Pat. No. 7,044,294, the content of which is herein incorporated by reference in its entirety.

It will be appreciated that there are disclosed herein a number of embodiments of a package 10, which are relatively simple and economic to make and assemble while providing an effective way of storing items, which can be quickly and easily accessed.

The particular proportions of the packages 10 disclosed herein are not critical. The proportions are preferably selected to provide a package 10 suitably sized to accommodate the particular articles to be packaged therein. In a preferred embodiment, the package 10 is pocket sized so as to fit in the palm of an adult user's hand or in a shirt pocket.

It can be appreciated that the package 10 can be used for a variety of products. For example, the package 10 can be used for commercially available smokeless pouched tobacco. Such tobacco pouches are sometimes known as "snus" and comprise an individual packet of tobacco material encased in a pouch material. A predetermined number of such pouches (e.g., 1-10, 10-15, 15-20, or more) can be placed in a plurality of recesses or cavities 32, wherein each of the plurality of recesses or cavities separates the product from one another either individually and/or groups of products from one another.

It can be appreciated that in accordance with another embodiment, a spent product can be placed within the recess or cavity 32 within the inner raised portion 30, which is isolated from the remaining unused tobacco product. The spent product can then be subsequently disposed of by disposing of the entire package.

Accordingly, there has been provided a package as described above, that has increased packaging/marketing flexibility, lower packaging cost, a lower cost to consumer to sample the product or variations of the product, improved sealing capabilities to improve shelf life, improved package appearance, and/or the capability for one package to contain multiple variations of the product without cross-contamination.

It should be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, exemplary embodiments, as well as alternative embodiments, may be made without departing from the spirit and scope of the articles and methods as set forth in the attached claims.

What is claimed is:

1. A package for a smokeless pouched tobacco product comprising a packet, said packet comprising:

a shaped front sheet having a raised inner portion, the raised inner portion having a plurality of recesses, which each contains at least one pouch of a smokeless tobacco material and a rim portion, which includes a pair of cut-outs along the rim portion on opposite edges of the packet to assist a consumer with grasping the packet; and a resealable back sheet, which peels away from the rim portion of the shaped front sheet without damaging either the shaped front sheet or the back sheet, such that an individual pouch of the smokeless tobacco material can be removed from the plurality of recesses, and the packet can be reclosed to preserve freshness of a remainder of contained product.

2. The package of claim 1, wherein the raised inner portion is hermetically sealed.

3. The package of claim 1, wherein the packet includes a tear notch at a corner of the packet to assist the consumer with the separation of the back sheet from the rim portion of the shaped front sheet.

4. The package of claim 1, wherein the back sheet is flat.

5. The package of claim 1, wherein the back sheet includes an openable window having a pull tab for access to the raised inner portion.

6. The package of claim 5, wherein the openable window is resealable.

7. The package of claim 1, wherein the rim portion is sealed to an outer portion of the back sheet.

8. The package of claim 1, wherein each of the plurality of recesses is individually sealed.

9. The package of claim 1, wherein the front sheet and back sheet are polypropylene.

10. The package of claim 1, wherein the raised inner portion of the shaped front sheet is formed by a bottom wall and sidewalls of the shaped front sheet.

11. The package of claim 1, wherein an outer surface of the bottom wall is embossed with product indicia.

12. The package of claim 1, further comprising a sleeve adapted to receive at least one packet such that the raised inner portion fits within an opening in a surface of the sleeve.

13. The package of claim 1, further comprising an adhesive between a rim portion of the shaped front sheet and an inner surface of the back sheet.

14. The package of claim 1, wherein the pair of cut-outs along the rim portion on opposite edges of the packet are not centered relative to a centerline of the packet so as to assist with balancing the packet during removal of the at least one pouch of the smokeless tobacco material from the plurality of recesses.

15. The package of claim 1, further comprising a rectangular shaped sleeve adapted to receive the packet, the sleeve including a pair of open ends, a front panel, a back panel, and two side panels, each of the two side panels having a resilient portion, which extends into the cut-outs of the packet so as to hold the packet in the sleeve, the resilient portions disengaging the cut-outs upon application of finger pressure on an end of the package to allow withdrawal of the packet from one of the open ends of the sleeve.

16. The package of claim 1, wherein the packet is pocket sized so as to fit in a palm of an adult user's hand and/or in a shirt pocket.

17. The package of claim 15, wherein the rectangular shaped sleeve is configured to hold one or more packets.

18. A resealable packet comprising:

a shaped front sheet having a raised inner portion, the raised inner portion having a plurality of recesses, which each contains at least one pouch of a smokeless tobacco material, and a rim portion, which includes a pair of cut-outs along the rim portion on opposite edges of the packet to assist a consumer with grasping the packet;

a resealable flat back sheet, which peels away from the rim portion of the shaped front sheet without damaging either the shaped front sheet or the back sheet; and wherein the back sheet hermetically seals the smokeless tobacco material within the shaped front sheet, such that an individual pouch of the smokeless tobacco material can be removed from the plurality of recesses, and the packet can be reclosed to preserve freshness of a remainder of contained smokeless tobacco material.

19. The packet of claim 18, wherein the packet includes a tear notch at a corner of the packet to assist the consumer with the separation of the back sheet from the rim portion of the shaped front sheet.

20. The packet of claim 18, wherein the back sheet includes a resealable openable window having a pull tab for access to the raised inner portion.

21. The packet of claim 18, wherein the pair of cut-outs along the rim portion on opposite edges of the packet are not centered along the opposite edges relative to a centerline of the packet so as to assist with balancing the package during removal of the at least one pouch of the smokeless tobacco material from the plurality of recesses.

22. A package for containing a smokeless pouched tobacco product comprising a packet, said packet comprising:

a shaped front sheet having a raised inner portion, the raised inner portion having at least one recess, which contains at least one pouch of a smokeless tobacco material and a rim portion, which includes a pair of cut-outs along the rim portion on opposite edges of the packet to assist a consumer with grasping the packet; and a back sheet attached to the rim portion of the shaped front sheet, and wherein the back sheet has an openable window having a pull tab for access to the raised inner portion, such that an individual pouch of the smokeless tobacco material can be removed from the at least one recess, and the packet can be reclosed to preserve freshness of a remainder of contained product.

23. The package of claim 22, wherein the at least one recess is a plurality of recesses, which each contains at least one pouch of the smokeless tobacco material.

24. The package of claim 22, wherein the pair of cut-outs along the rim portion on opposite edges of the packet are not centered along the opposite edges relative to a centerline of the package so as to assist with balancing the package during removal of the at least one pouch of the smokeless tobacco material from the plurality of recesses.

* * * * *